US005513460A

United States Patent [19]

Van Niekerk et al.

[11] Patent Number: 5,513,460

[45] Date of Patent: May 7, 1996

[54] SAFETY AND/OR DISMANTLING DEVICE FOR A FIREARM AND THE LIKE

[75] Inventors: Pieter W. Van Niekerk; Daniel J. J. Maritz; Kurt K. Prinsloo, all of Verwoerdburg; Jakob De Bruin; Brian Koekemoer, both of Pretoria; Echbertus H. D. Greeff, Verwoerdburg, all of South Africa

[73] Assignee: Denel (Pty) Limited, South Africa

[21] Appl. No.: 348,620

[22] Filed: Dec. 2, 1994

[30] Foreign Application Priority Data

Dec. 6, 1993 [ZA] South Africa ..... 93/6548

[51] Int. Cl.[6] ..... F41A 17/54

[52] U.S. Cl. ..... 42/70.06; 42/70.07

[58] Field of Search ..... 42/70.06, 70.04, 42/70.07; 89/148, 150

[56] References Cited

U.S. PATENT DOCUMENTS 2,571,132 10/1951 Harvey ..... 42/70.06

3,153,874 10/1964 Merrill ..... 42/70.06

FOREIGN PATENT DOCUMENTS 24659 of 1905 United Kingdom ..... 42/70.06

*Primary Examiner*—Stephen M. Johnson

*Attorney, Agent, or Firm*—Banner & Allegretti, Ltd.

[57] ABSTRACT

A safety and dismantling device (10) for a trigger operated firearm (18) is provided which includes a lever (12). The lever is slidably movable relative to the firearm (18) from a 'safe' position where it serves releasably to lock the trigger (20) against movement in that direction where it can activate the firing mechanism of the firearm (18), to at least a 'fire' position, where it does not so lock the trigger. The lever (12) is located toward the front end of the firearm (18) and substantially in the same plane as the firearm (18). Movement of the lever (12) is through a slot (13) in the leading end of the trigger guard (28) of the firearm (18) and the lever can also move to a 'dismantling' position where the slide (25) of the firearm (18) can be removed to allow access to the underlying components of the firearm (18) for dismantling purposes.

11 Claims, 3 Drawing Sheets

SAFETY AND/OR DISMANTLING DEVICE FOR A FIREARM AND THE LIKE

INTRODUCTION AND BACKGROUND

This invention relates to a safety and dismantling device for a firearm or the like and more particularly it relates to a safety device for temporarily immobilising the trigger of such a firearm and for dismantling the firearm into its constituent components.

In this specification the word "firearm" is meant also to include any projectile emitting weapon which does not use explosive ammunition such as, for example, "cross bows" and the like.

Many types of safety devices for firearms are known. Most of these comprise a lever or the like located on one or both longitudinal sides of the firearm which lever serves temporarily to lock the trigger of the firearm in a non-firing position. Apart from presenting a transversely extending obstacle which can hook onto extraneous articles, such known devices also serve to increase the width of the firearm thus making it more bulky when carried on a person's body or in a holster or the like. Such known devices are usually also intended to fulfil a single function only, i.e. temporarily to immobilise the trigger of the firearm.

OBJECT OF THE INVENTION

It is an object of this invention to provide a safety and dismantling device for a firearm or the like which will overcome or at least minimise some of the disadvantages of the known devices.

SUMMARY OF THE INVENTION

According to the invention a safety and dismantling device for a trigger operated firearm includes a lever which is slidably movable relative to the firearm from a first or 'safe' position where it serves releasably to lock the trigger against movement in that direction where it can activate the firing mechanism of the firearm, to at least a 'fire' position, where it does not so lock the trigger; the lever being located towards the front end of the firearm and substantially in the same plane as the firearm.

In this specification the term 'plane of the firearm' is meant to refer to the vertical plane in which the firearm extends when it is held in its normal firing position.

It will be appreciated that with the aforesaid arrangement the lever can be of such configuration that it does not protrude on either side of the firearm, and therefore not contribute to its cross sectional width, and also not present any transversely extending obstacle which can hook onto extraneous articles during handling of the firearm.

Further according to the invention the firearm includes a substantially circular trigger guard which includes a slot towards its leading end through which the lever is movable, the arrangement being such that part of the lever extends into the area encircled by the trigger guard when the lever is not in the 'fire' position.

Still further according to the invention the lever includes a marked zone which is located outside the area encircled by the trigger guard when the lever is in the 'fire' position.

It will be appreciated that the presence of such a zone, which may for example be coloured red, will indicate to a potential user of the firearm that it is in the 'fire' mode.

Further according to the invention the device includes a stop which prevents the slide of the firearm from sliding past it when the lever is in the 'fire' or 'safe' position, thus preventing the slide from being removed from the fire arm, the slide stop being slidably movable relative to the lever in a direction extending transversely the longitudinal axis of the barrel of the firearm between a first position where the lever is in said 'safe' position to at least one further position where the lever is in said 'fire' position.

Further according to the invention the slide stop is also slidably movable relative to the lever to a third or 'dismantling' position where it allows the slide of the firearm to slide past it to a position where it can be removed from the firearm in order to allow access to the underlying components of the fire arm.

Preferably the slide stop comprises two elongated members in substantially parallel spaced relationship to each other, the one set of ends of which is interconnected by a transversely extending rod.

Further according to the invention the lever includes an angled slot in which the said rod is slidably movable from a first position located towards the one end of the slot, which corresponds to the position where the lever is in the 'fire' position; to a second position where the lever is in the 'safe' position; and to a third position where the lever is in the 'dismantling' position.

Still further according to the invention the device includes a trigger lock comprising an elongated element of which the one end can engage the trigger so that it is movable with the trigger when the lever is in the 'fire' position, and of which the other end can releasably be trapped against such movement by at least one of the said elongated members when the lever is in the 'safe' or 'dismantling' positions.

Further according to the invention at least one of the said elongated members includes a slot through which the said other end of the trigger lock element can pass slidably when the lever is in the 'fire' position, the arrangement being such that when the lever is in the 'safe' or 'dismantling' position the said member presents an obstacle against such sliding movement of the trigger lock element.

Preferably the said one end of the trigger lock element includes a hook formation adapted releasably to engage a complimentary shaped formation on the trigger.

Still further according to the invention the lever includes a transversely extending elongated lip formation which is adapted slidably to engage a complimentary shaped groove in the body of the firearm to allow for said sliding movement of the lever between its 'fire', 'safe' and 'dismantling' positions.

Still further according to the invention the lever also includes a transversely extending elongated ledge which is located adjacent said lip formation, the ledge providing a track which can be engaged slidably by the said other end of the trigger locking element during its said movement while the lever is in the 'fire' position.

Still further according to the invention the lever is provided with a spring biased pin of which the free end is adapted in turn releasably to engage complimentary shaped recesses on the body of the firearm when the lever is in the said 'fire' and 'safe' positions respectively.

DESCRIPTION OF THE DRAWINGS

One embodiment of the invention will now be described by way of example only with reference to the accompanying drawings, in which.

DESCRIPTION OF A PREFERRED EMBODIMENT

Figure 1:
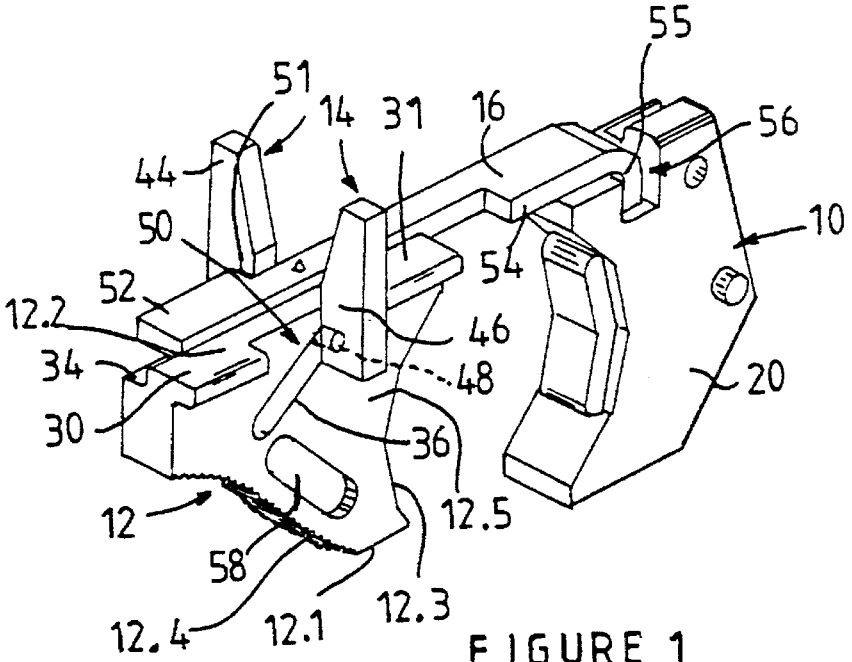
FIG. 1 is a perspective view of the constituent parts of a safety and dismantling device according to the invention.

In this embodiment of the invention a safety and dismantling device according to the invention for a pistol 18 is generally indicated by reference numeral 10.

Safety and dismantling device 10 comprises a safety lever 12 of substantially flat triangular shape comprising an apexed end 12.1; a base side 12.2; a leading side 12.3; a trailing side 12.4, and two parallel spaced substantially triangular faces 12.5.

Figure 6:
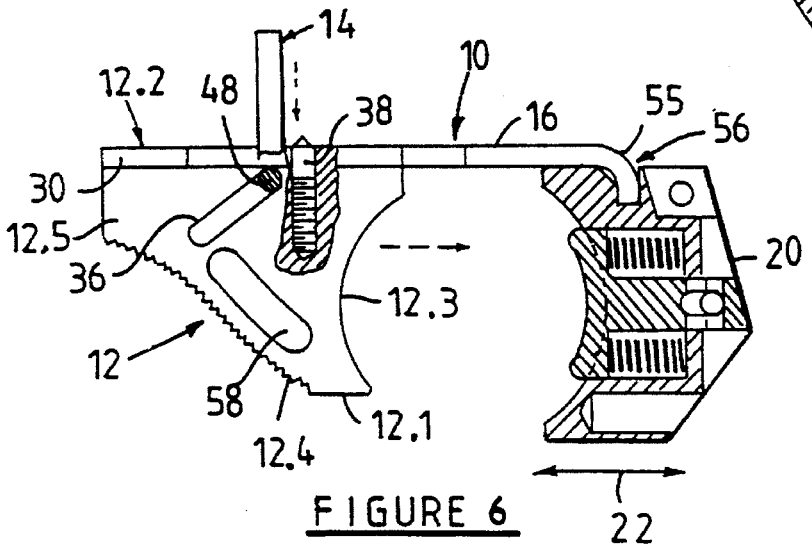
FIG. 6 is a side view, partly in section, of the device of FIG. 1 in the 'fire' position.

Device 10 also includes a slide stop 14 slidably movable relative to lever 12 in a direction transversely the longitudinal axis of pistol 18, i.e. in the direction indicated by arrow A5 in FIG. 6.

Figure 7:
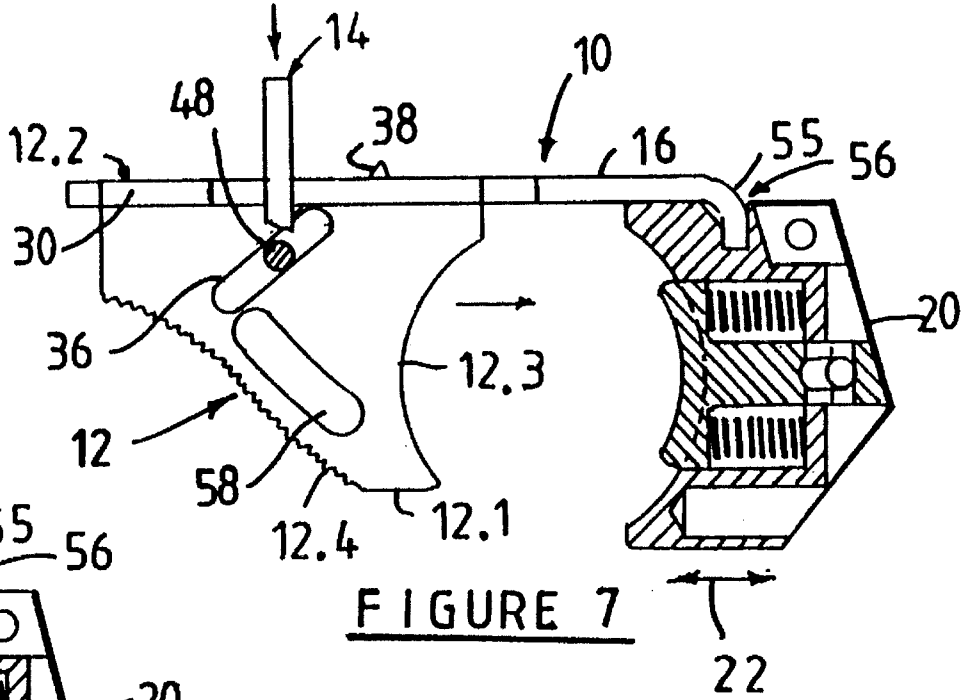
FIGS. 7 and 8 are views similar to that of FIG. 6 illustrating the device of FIG. 1 in the 'safe' and 'dismantling' positions respectively.

Pistol 18 is characterised in that it comprises a sliding-type trigger 20, which is reciprocally movable in the direction of double-headed arrow 22 (FIGS. 6–8), which direction is parallel to the longitudinal axis of barrel 24 of pistol 18 and hence to pistol 18. Pistol 18 also includes a slide 25 in the form of a barrel-enclosing casing by means of which pistol 18 can automatically or manually be reloaded.

Pistol 18 further comprises a bed 26 for slide 25; a hand engagable grip 27; and a conventional substantially circularly shaped trigger guard 28 which extends from grip 27 to slide bed 26. The leading end of trigger guard 28 includes a slot 13 which extends parallel to the longitudinal axis of barrel 24 and through which the leading side 12.3 of lever 12 can pass slidably in order to be located in any one of three predetermined positions of which more details will be given later.

Lever 12 includes along its base side 12.2 two elongated lip formations 30 and 31 which extend transversely one of the triangular faces 12.5 of lever 12. Formations 30 and 31 are separated by a cut out part 50. Lip formations 30 and 31 can slidably engage a complimentary shaped slot (not shown) provided in slide bed 26, which slot extends parallel to the said longitudinal axis of barrel 24.

Base side 12.2 of lever 12 also includes a ledge 34 provided in that triangular face 12.5 opposite the one from which formations 30 and 31 extend, which ledge extends parallel to the said slot (not shown) provided in slide bed 26.

Lever 12 also includes an elongated slot 36 which extends through the body of lever 12 and which is set at an angle in the order of 45 degrees relative to the said longitudinal axis of barrel 24.

Figure 2:
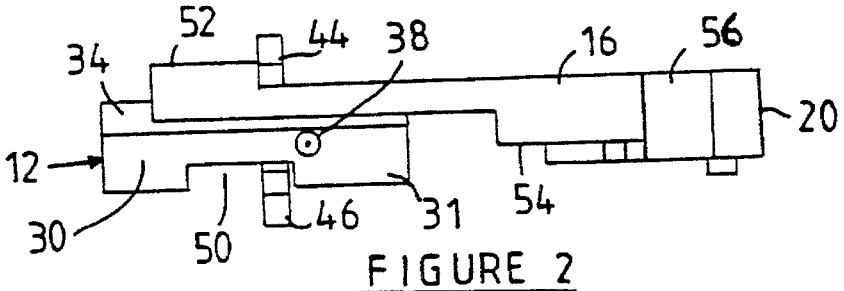
FIG. 2 is a plan view of the device shown in FIG. 1.
Figure 3:
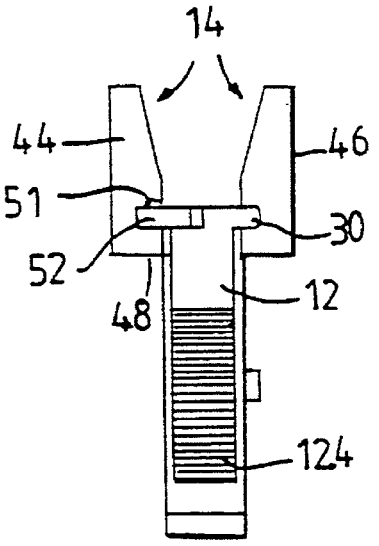
FIG. 3 is an end-on view of the device of FIG. 1 as seen in the direction of arrow A3 in FIG. 1.

Lever 12 furthermore includes a transversely extending, spring-loaded, conically tipped pin 38 located in a blind hole provided in the body of lever 12, the open end of the hole being located in the face of base side 12.2 of lever 12. The tip of pin 38 can, in use, releasably engage any one of two complimentary recesses 40 and 42 (FIG. 2) provided in slide bed 26 in order to locate lever 12 relative to slide bed 26 in two predetermined positions.

Slide stop 14 comprises two elongated parallel spaced members 44 and 46 of which the one or lower set of ends are interconnected by an elongated rod 48 which is slidably received in slot 36. Rod 48 is of a longer length than the cross sectional width of lever 12 so that when lever 12 is moved relative to slide stop 14 in the direction of arrow 22, rod 48 can slide along slot 36 with the inner edges of members 44 and 46 slidably engaging opposite triangular faces 12.5 of lever 12. The aforesaid cut out 50 located between formations 30 and 31 in lever 12 defines the distance through which lever 12 can so move relative to stop 14.

It will hence be appreciated that when lever 12 is so moved relative to slide stop 14, members 44 and 46 will move in the direction indicated by arrow A5 in FIG. 6, i.e. at right angles to the aforesaid longitudinal axis of barrel 24. For this purpose slide bed 26 is provided with a transversely extending slot (not shown) in which the upper ends of members 44 and 46 are received slidably, the arrangement being such that when rod 48 is moved to the lowermost end of slot 36 indicated in FIG. 8, the said upper ends of members 44 and 46 are completely withdrawn into such slot (not shown) thus allowing slide 25 to slide past them along slide bed 26.

Trigger lock 16 comprises a substantially flat elongated element of which the opposite ends each includes a transversely extending flange 52 and 54 respectively. The latter end is bent through approximately 90 degrees to define a hook formation 55 which can releasably engage a complimentary shaped formation 56 extending transversely the upper end of trigger 20. It will be appreciated that when hook formation 55 engages formation 56, lock element 16 will be movable with trigger 20 in the direction of arrow 22.

That end of lock 16 containing flange 52 is adapted to slide along a path defined between the said ledge 34 on lever 12 and a groove (not shown) provided in slide bed 26, the said groove also extending parallel to the said longitudinal axis of barrel 24. Member 44 of slide stop 14 includes a slot 51 through which flanged end 52 can slide when lever 12 is in one of its aforesaid predetermined positions.

Figure 5:
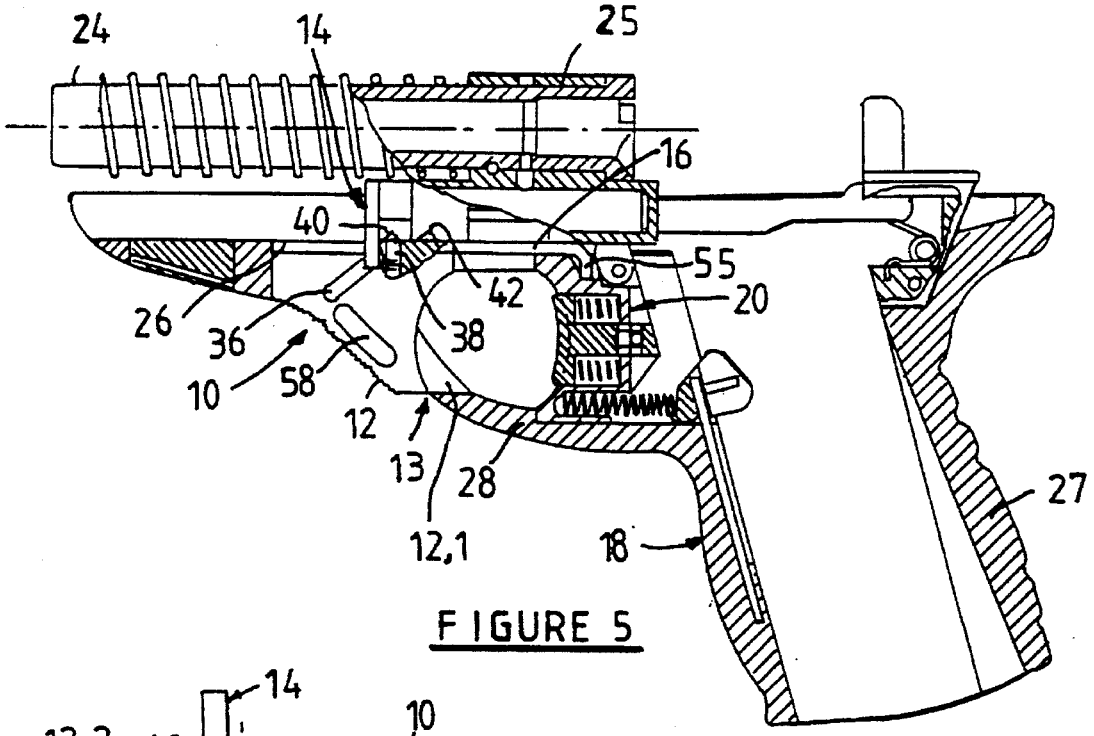
FIG. 5 is a side view of the device of FIG. 1 shown in position on a firearm in the form of a pistol which is partly shown in cross section.

It will be appreciated that when lever 12 is moved in the direction of arrow 22 along its aforesaid sliding path, members 44 and 46 will be caused to rise or fall in the direction of arrow A5 in FIG. 6, the arrangement being such that when lever 12 is moved to its one extreme position where rod 48 is located at the uppermost end of slot 36 (indicated in FIGS. 1 and 5, and hereinafter referred to as the 'fire' position, pin 38 engages recess 40 and members 44 and 46 are located in their uppermost position. While in this position, flange 52 on lock 16 can slide along slot 51 on member 44 when trigger 20 is pulled to fire pistol 18. It will be appreciated that such movement of lever 12 to its 'fire' position can be effected by the trigger finger of the person operating pistol 18 by pushing with such finger against the leading end 12.3 of lever 12 from within the area defined by trigger guard 28.

Figure 4:
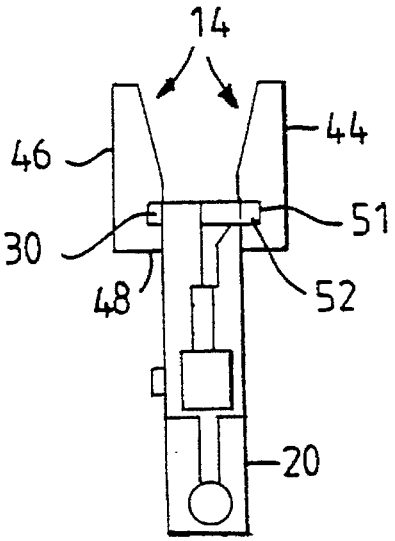
FIG. 4 is an end-on view of the device of FIG. 1 as seen in the direction of arrow A4 in FIG. 4.

When lever 12 is moved to that position where the tip of pin 38 engages recess 42 (hereafter referred to as the 'safe' position), rod 48 will be in the position shown in FIG. 4 where members 44 and 46 are in their intermediate position along slot 36. Slot 51 in member 44 is then not in line with flange 52 so that member 44 provides an obstacle to the aforesaid movement of locking element 16, and thus trigger 20, so that trigger 20 cannot be pulled to fire pistol 18.

It will be appreciated that when device 10 is in either one of the aforesaid 'fire' or 'safe' positions, the upper ends of members 44 and 46 project through the upper face of slide bed 26 thus providing a stop preventing slide 25 from sliding past members 44 and 46 to the rear end of pistol 18.

Figure 8:
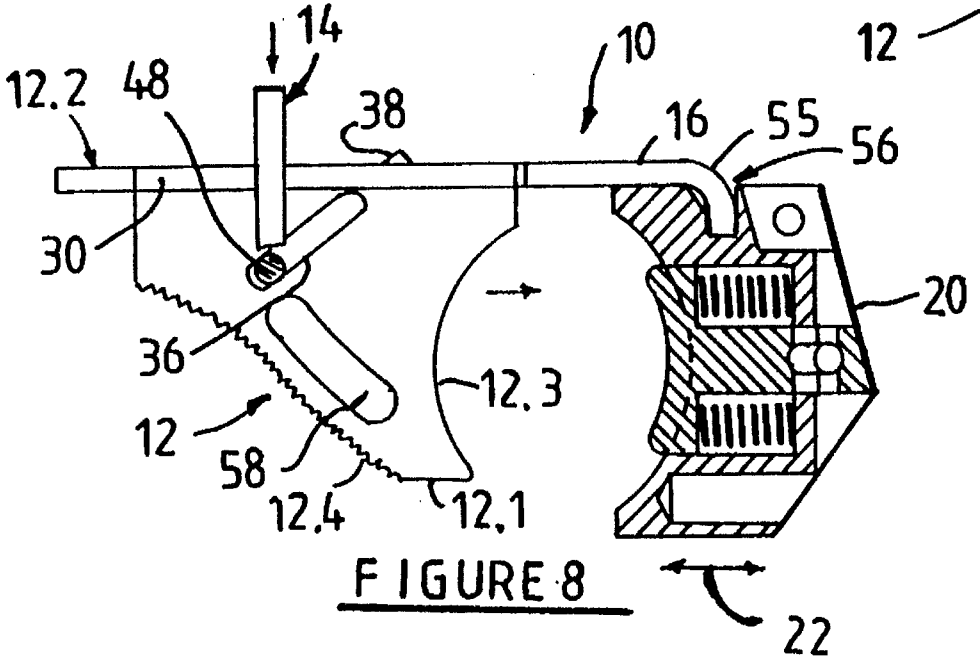

When lever 12 is moved to that position where rod 48 is in the position indicated in FIG. 8, i.e. at the other extreme or lowermost end of slot 36, hereafter referred to as the 'dismantling' position, members 44 and 46 are in their lowermost position and their free ends are retracted in the aforesaid slot (not shown) to a position below the upper face of slide bed 26, thus allowing slide 25 to slide past members 44 and 46 to an extreme position towards the rear end of pistol 18 where slide 25 can be removed to expose the underlying parts of pistol 18 for dismantling purposes.

Each of faces 12.5 of lever 12 includes a similar slightly curved, elongated, blind substantially eliptically shaped recess 58 located towards its trailing side 12.4. Recesses 58, which are each coloured bright red, are located in such positions on faces 12.5 that they are located outside the aforesaid area defined between the inside of trigger guard 28 and trigger 20 when pistol 18 is in the 'fire' mode, their red colour serving to alert a would be user of pistol 18 that it is unsafe. When lever 12 is moved to the 'safe' position, recesses 58 are obscured by trigger guard 28. Recesses 58 accordingly provide visible means for indicating each of the modes of pistol 18.

It will be appreciated that if a pistol holster is provided which includes a sheath which fits snugly around trigger guard 28, and pistol 18 is inserted into such sheath while it is in the "fire" mode, lever 12 will be caused automatically to move to the 'safe' position as a result of the interaction between the trailing side 12.4 of lever 12 and the inner surface of such sheath, thereby rendering pistol 18 'safe'.

It will be appreciated further that the invention provides a safety and dismantling arrangement which has distinct advantages over the known arrangements referred to in the preamble of this specification. Thus it will be appreciated that the location, line of movement and configuration of lever 12 serve to lessen the relative width of pistol 18 compared to conventional pistols, thereby rendering it relatively less bulky when carried on the body of a person. Also, because the safety device presents no transversely extending protrusions, it is less susceptible to hook onto extraneous articles during use.

It will further be appreciated that the invention also includes within its scope a firearm, particularly a pistol, provided with a safety and dismantling device according to the invention.

It will still further be appreciated that there are no doubt many variations in detail possible with a safety and dismantling device according to the invention without departing from the scope of the claims.

We claim:

1. A safety and dismantling device for a trigger operated firearm of the type which includes an elongated barrel and a slide which is slidably movable relative to the barrel during the loading, unloading and firing of the firearm, the device being characterized in that it includes a lever which is slidably movable relative to the firearm from a 'safe' position where the lever serves releasably to lock the trigger against movement in that direction wherein the trigger can cause the firing of the firearm, to a 'fire' position where the lever does not so lock the trigger, and to a 'dismantling' position; the device also including a slide stop which prevents the slide of the firearm from sliding past the stop when the lever is in the aforesaid 'fire' or 'safe' positions, thus preventing the slide from being removed from the firearm; the slide stop being slidably movable relative to the lever in a direction extending transversely to the longitudinal axis of the barrel of the firearm between a first position when the lever is in the said 'safe' position, a second position when the lever is in the said 'fire' position, and a third position when the lever is in said 'dismantling' position, so that when the slide stop is in the latter position the slide stop allows the slide of the firearm to slide past the slide stop to a position where the slide can be removed from the firearm.

2. The device of claim 1 wherein the firearm includes a annular trigger guard which is provided towards an end of the guard nearest the firing end of the barrel with a slot through which the lever is movable, so that part of the lever can extend through the slot towards the trigger so that it extends on one side of the said end when the lever is in any of its aforesaid positions other than the 'fire' position.

3. The device of claim 2 wherein the lever includes a marked zone which extends on the opposite side of the said end of the trigger guard when the lever is in the 'fire' position.

4. The device of claim 1 wherein the slide stop comprises two elongated members in substantially parallel spaced relationship to each other, having two sets of opposite ends, one set of ends of the members being interconnected by a transversely extending rod.

5. The device of claim 1, wherein the lever includes a transversely extending elongated lip formation which is adapted slidably to engage the firearm to allow for said sliding movement of the lever.

6. The device of claim 1 wherein the lever is provided with an elongated spring biased pin of which one end is adapted in turn releasably to engage complementary shaped recesses on the firearm when the lever is in the 'fire' and 'safe' positions, respectively.

7. The device of claim 7 wherein the slide stop comprises two elongated members in substantially parallel spaced relationship to each other and of which one set of ends are interconnected by a transversely extending rod, and wherein the device also includes an elongated trigger lock element of which one end can engage the trigger of the firearm so that the element is movable With the trigger when the lever is in the 'fire' position, and of which the other end can releasably be trapped against such movement by the said elongated members when the lever is in any one of its 'safe' or 'dismantling' positions.

8. The device of claim 7 wherein the lever includes an angled elongated slot with two opposite ends in which slot the said rod is slidably movable from a first position located toward the one end of such slot which corresponds to the position when the lever is in the 'fire' position; to a second position when the lever is in the 'safe' position; and to a third position when the lever is in the 'dismantling' position.

9. The device of claim 7 wherein at least one of the said elongated members includes a slot through which the said other end of the trigger lock element can pass slidably when the lever is in the 'fire' position, in that when the lever is either in its 'safe' or 'dismantling' positions, the said member presents an obstacle against such sliding movement of the trigger lock element.

10. The device of claim 7 wherein the said one end of the trigger lock element includes a hook formation adapted releasably to engage a complementary shaped formation on the trigger.

11. The device of claim 7, wherein the lever includes a transversely extending elongated lip formation which is adapted slidably to engage the firearm to allow for said sliding movement of the lever and a transversely extending elongated ledge which is located adjacent said lip formation, the ledge providing a track which can be engaged slidably by the said other end of the trigger lock element during its said movement while the lever is in the 'fire' position.

* * * * *